United States Patent [19]

Saffer et al.

[11] Patent Number: 4,521,206

[45] Date of Patent: Jun. 4, 1985

[54] TRACK FOR TOY VEHICLES

[75] Inventors: Gary M. Saffer; Gérard L. Lambert, both of Torrance; Howard R. Stern, El Segundo, all of Calif.

[73] Assignee: Mattel, Inc., Hawthorne, Calif.

[21] Appl. No.: 565,307

[22] Filed: Dec. 27, 1983

[51] Int. Cl.[3] ..... A63H 18/02

[52] U.S. Cl. ..... 446/444; 238/10 R; 238/10 A

[58] Field of Search ..... 446/431, 444, 445; 273/86 R; 238/10 R, 10 A, 10 B; 104/53

[56] References Cited

U.S. PATENT DOCUMENTS 2,306,049 12/1942 Fernandez ..... 273/86 R
3,218,757 11/1965 Benkoe ..... 446/444
3,860,237 1/1975 Cooper et al. ..... 273/86 R
4,449,665 5/1984 Goldfarb et al. ..... 238/10 F X

*Primary Examiner*—Robert B. Reeves
*Assistant Examiner*—Glenn B. Foster
*Attorney, Agent, or Firm*—Ronald M. Goldman; James G. O'Neill

[57] ABSTRACT

An improved track for a toy vehicle is disclosed which is in the form of a one-hundred-eighty degree curve. A wall portion of the track is configured to contact a front portion on a first side of the vehicle as it moves along the curve. A post is located at approximately the geometric center of the curve at a position which causes a rear portion on the second side of the vehicle to contact and to pivot around the post as the vehicle moves along the curve.

4 Claims, 9 Drawing Figures

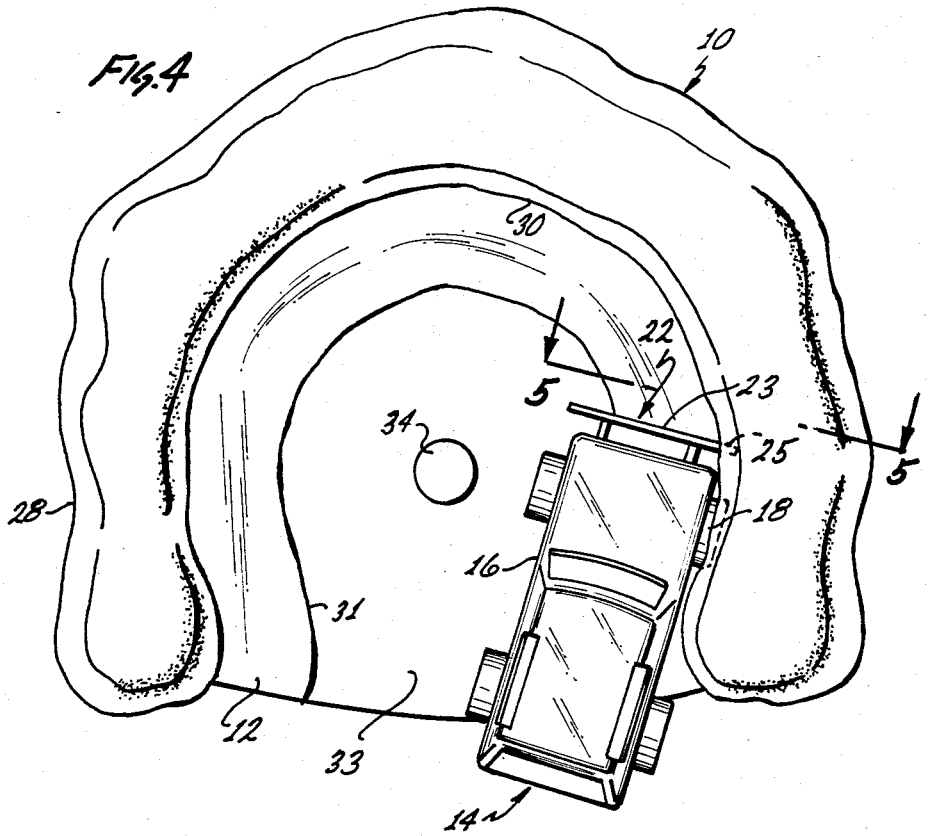
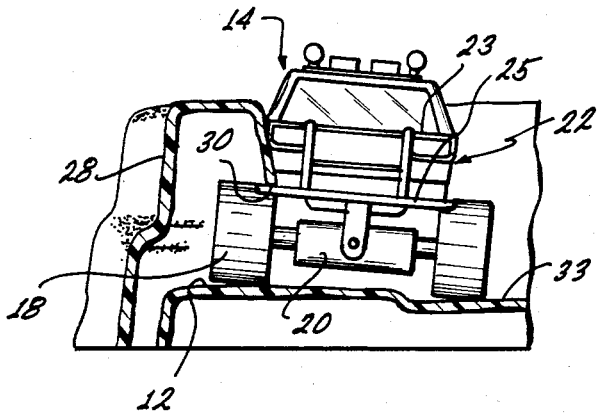
FIG. 5

TRACK FOR TOY VEHICLES

TECHNICAL FIELD

This invention relates to toy tracks and, more particularly, to toy tracks having sharp curves for use with self-propelled toy vehicles.

BACKGROUND ART

Over the years, a great variety of toy vehicle sets have been designed. These sets typically include one or more self-propelled vehicles, and one or more sections of track for supporting and guiding these vehicles over a course. To enhance the excitement of these toys, various curved tracks are provided which form winding and torturous courses for the vehicles.

One of the difficulties in the design of curved track for toy vehicles is that of ensuring that the vehicle can successfully negotiate the curve. In some instances, the vehicle has a tendency to fly off the track, while in other instances the vehicle tends to stall against a portion of the curved track. Because of these difficulties, many prior art toy vehicle sets are limited to tracks having only gradual curves, for example, a curve in which the average radius is many times larger than the length of the toy vehicle.

Accordingly, it is an object of the present invention to provide a new and improved track for toy vehicles.

It is another object of the present invention to provide a curved toy track for use with toy vehicles having a length greater than the radius of the curve.

It is yet another object of the present invention to provide a curved toy track which assists a toy vehicle in negotiating the curve.

DISCLOSURE OF INVENTION

The foregoing and other objects of the invention are accomplished by a curved track having a surface portion over which a toy vehicle travels. A wall portion of the track upstanding from the surface portion is provided with a curved inner surface which defines the curved portion of the track. The inner surface is designed to contact a forward part of the body of the toy vehicle when it is traveling around the track.

A generally cylindrical post upstanding from the surface portion is positioned a predetermined distance from the inner surface so that as the vehicle enters the curved portion of the track, the forward part on a first side of the vehicle body contacts the inner surface and a rear part on a second side of the vehicle body opposite the first side contacts the post. This arrangement causes the vehicle to pivot about the post in a direction which greatly assists the vehicle in negotiating the curved portion of the track.

Other objects, features, and advantages of the invention will become apparent from a reading of the specification when taken in conjunction with the drawing in which like reference numerals refer to like elements in the several views.

BRIEF DESCRIPTION OF DRAWINGS

FIG. 4 is a top view of the track of FIG. 1 showing the vehicle of FIG. 2 entering the curved portion of the track;

FIG. 5 is a cross-sectional view of FIG. 4 taken along the line 5—5 and showing the engagement between a front guide rod of the vehicle of FIG. 2 and an inner lip of the track;

BEST MODE FOR CARRYING OUT THE INVENTION

Figure 1:
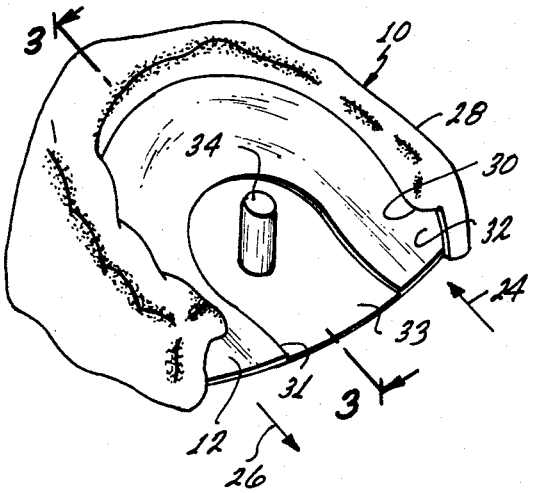
FIG. 1 is a perspective view of a toy track constructed in accordance with the teachings of the present invention.
Figure 2:
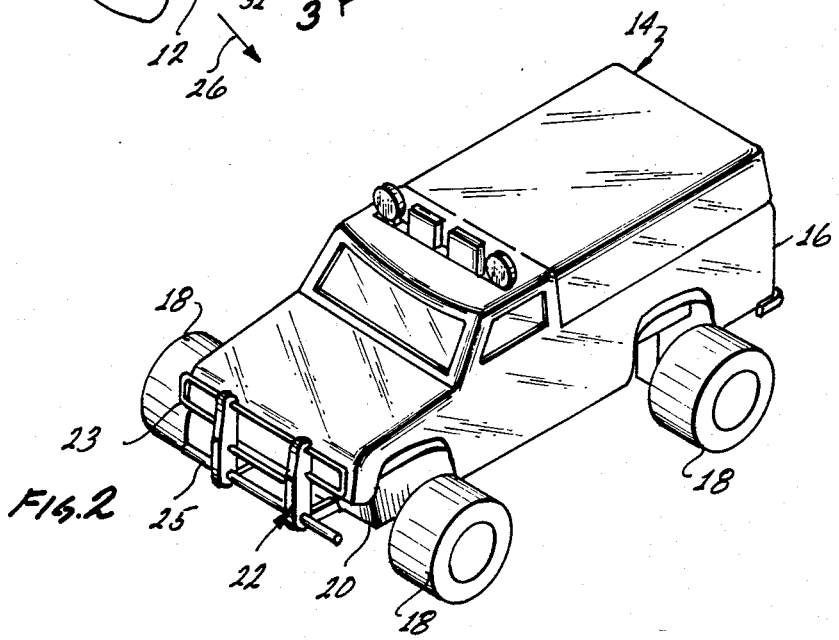
FIG. 2 is a perspective view of a toy vehicle for use with the toy track of FIG. 1.

Referring now to FIG. 1 there is shown a perspective view of a curved toy track 10 constructed in accordance with the invention. The track 10 includes a surface 12 for supporting a vehicle 14 such as a toy truck shown in FIG. 2.

The vehicle 14 may be any one of a number of types of self-propelled vehicles having a body 16 supported on wheels 18. In the preferred embodiment, the vehicle 14 includes an inertia motor 20 having a flywheel connected to a geartrain (not shown) which is in turn coupled to all four wheels 18. Energy is stored in the flywheel by, for example, pushing the vehicle along a surface until the wheels are rotating at the desired speed. The flywheel inertia will then enable the vehicle 14 to move by itself over a substantial distance. Inertia motors of this type are well known to those skilled in the art. The vehicle 14, in the preferred embodiment, is shaped to resemble a four-wheel drive truck for use in off-road travel. A bumper 22 extends across the front of the vehicle 14 and includes a brush bar 23 and a guide rod 25. As described below, both the brush bar 23 and the guide rod 25 cooperate with a portion of the track 10 to assist the vehicle 14 in negotiating the curve.

The curved track 10 is designed to be one of a plurality of sections of track which may be combined by the user to form a course for the vehicle 14. Referring to FIG. 1, it may be seen that the track 10 provides a one-hundred-eighty degree turn, whereby the vehicle 14 enters the track 10 in the direction of arrow 24 and leaves the track 10 in the direction of arrow 26.

The track 10 includes a wall 28 upstanding from the surface 12. The wall 28 has a lip 30 which is in the shape of the turn, and projects inward from the wall 28 at a predetermined distance above the surface 12, thus forming a recess 32 around the inner periphery of the track 10. In the surface 12, a curved step 31 is provided which forms a recessed surface 33 approximately one-eighth of an inch below the surface 12 in a central portion of the track 10. A generally cylindrical post 34 projects from the surface 33 at a predetermined distance from the lip 30 and acts to guide the vehicle 14 around the track 10 in the manner described below.

Figure 3:
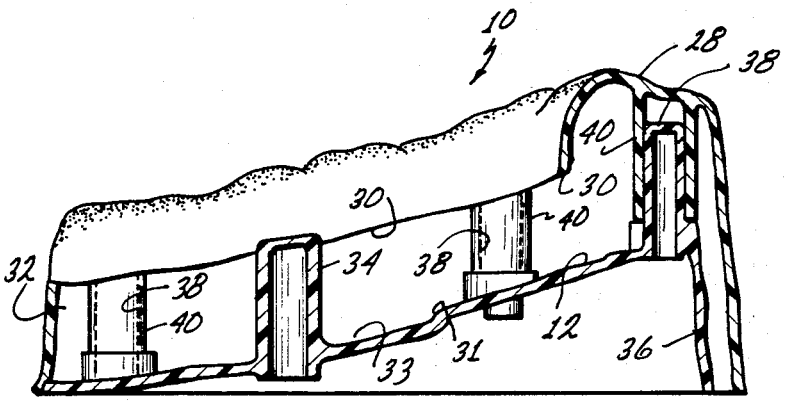
FIG. 3 is a cross sectional view of the toy track of FIG. 1 taken along line 3—3 of FIG. 1.

In the preferred embodiment of the invention, the track 10 is constructed in two parts, as shown in the cross-sectional view of FIG. 3. The surface 12 is formed of a moldable plastic material, such as polyethylene, and includes a tapered skirt 36 which depends therefrom. The skirt 36 acts to incline the surface 12 so that the track 10 presents an uphill grade, as well as a sharp curve, to the vehicle 14.

The post 34 is molded as an integral part of the surface 12, as are a plurality of upstanding cylindrical bosses 38. The bosses 38 are positioned around the outer periphery of the surface 12 and are used to connect it to the wall 28.

The wall 28 is also formed of a moldable plastic material, which may be the same as that used to form the surface 12. A plurality of hollow cylindrical tubes 40 are provided around the periphery on the underside of the wall 28. The tubes 40 are designed to slip over and tightly engage the bosses 38 when the wall 28 is assembled onto the surface 12, thus forming the completed track 10.

The interaction of the track 10 with the vehicle 14 will now be described with reference to FIGS. 4–9. FIG. 4 shows the position of the vehicle 14 as it enters the track 10 and FIG. 5 shows the interaction between portions of the vehicle 14 and the track 10. As the vehicle 14 enters and travels around the track 10, the height of the lip 30 above the surface 12 is such that the side of the brush bar 23 contacts and slides along the lip 30, while the wheels 18 move within the recess 32. The recess 32 is sized to provide clearance for the wheels 18 so that they may rotate without rubbing against the wall 28.

The bar 23 may be formed of a resilient material to assist the sliding action against the lip 30. From FIG. 5, it may be seen that the guide rod 25 is positioned beneath the lip 30 as the vehicle 14 travels around the track 10. It may also be seen that the wheels 18 on the right side of the vehicle 14 travel on the surface 12, while the wheels 18 on the left side of the vehicle 14 travel on the recessed surface 33, whereby the vehicle 14 is tilted toward the post 34.

Figure 6:
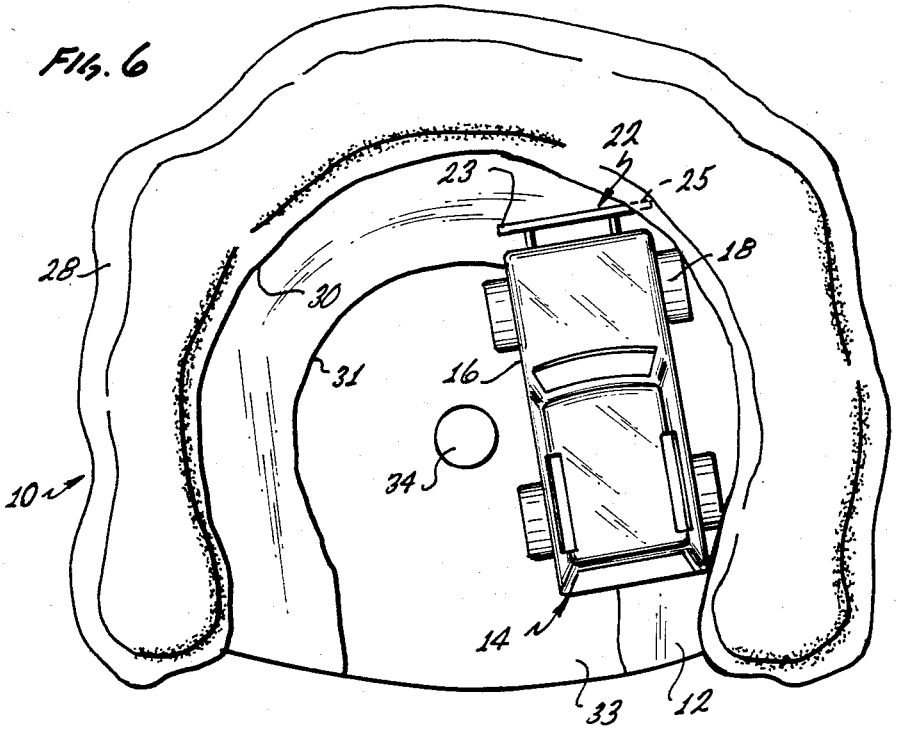
FIG. 6 is similar to FIG. 4 except showing the toy vehicle at a point approximately one-quarter the distance around the curved portion of the track.
Figure 7:
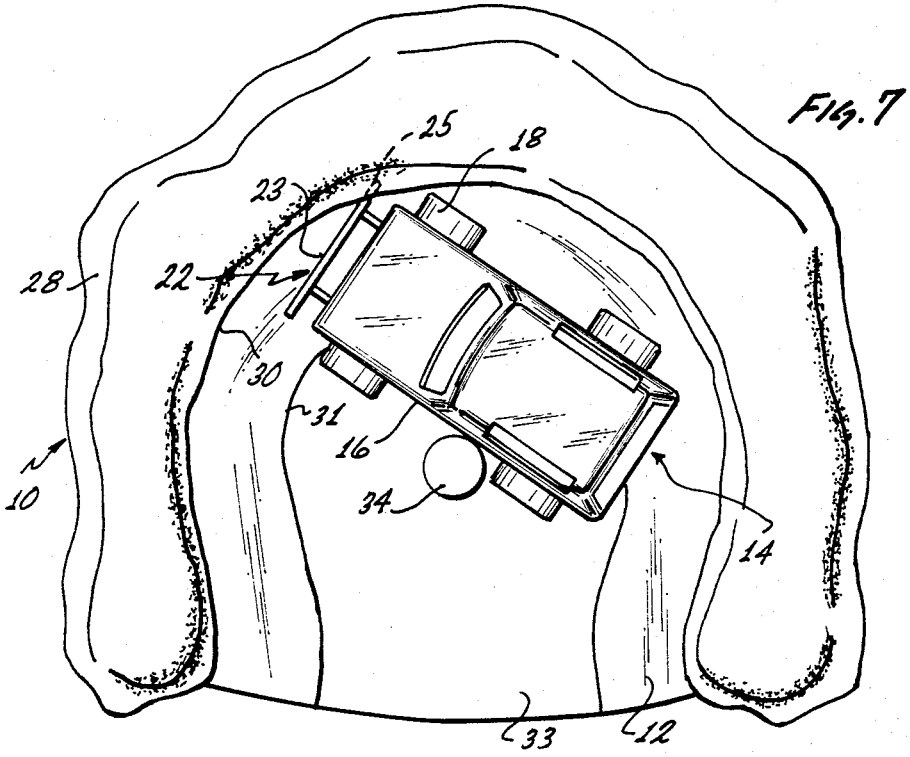
FIG. 7 is similar to FIG. 4 except showing the toy vehicle at a point approximately one-half the distance around the curved portion of the track.
Figure 8:
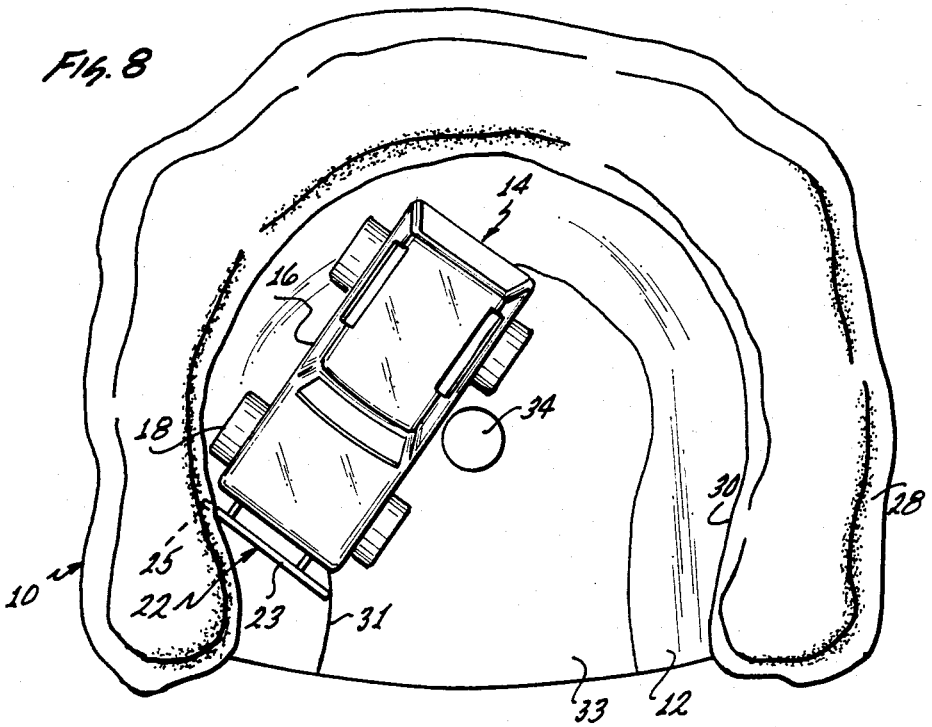
FIG. 8 is similar to FIG. 4 except showing the toy vehicle at a point approximately three-quarters the distance around the curved portion of the track.
Figure 9:
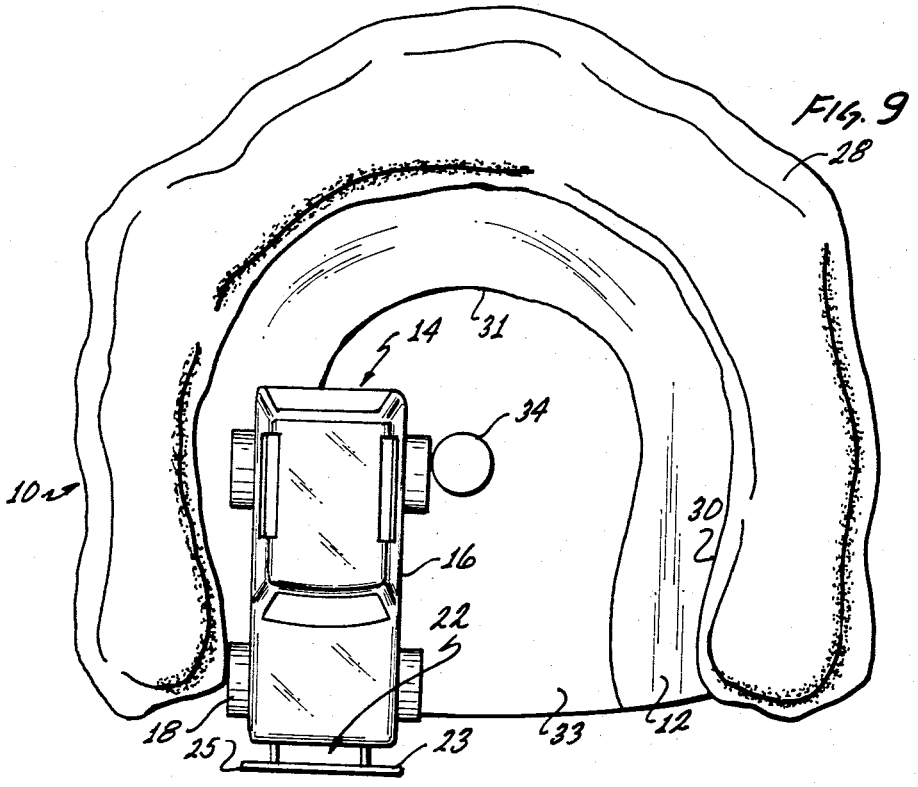
FIG. 9 is similar to FIG. 4 except showing the toy vehicle exiting the curved portion of the track.

FIG. 6 shows that as the vehicle 14 proceeds along the track 10, a portion on the left side of the vehicle body 16 approaches the post 34. The post 34 is located at approximately the center of the track 10 and sufficiently close to the lip 30 to contact a portion of the left side of the vehicle 14 in a manner which causes it to pivot about the post 34 as the vehicle proceeds further around the track 10. This pivoting action is clearly shown in FIGS. 7–9, which show, sequentially, the position of the vehicle 14 as it moves around the track 10. The pivoting action is a result of the forward motion of the vehicle 14, the bar 23 contacting the lip 30 on the right side of the vehicle, and the post 34 contacting the body 16 on the opposite, or left side of the vehicle. The pivoting action just described greatly assists the vehicle 14 in negotiating the U-turn and eliminates any tendency of the vehicle 14 to stall against the wall 28.

The guide rod 25 positioned beneath the lip 30 prevents the vehicle 14 from lifting up and climbing out of the track 10. It has been found that the high speed rotation of the flywheel in the inertia motor 20 of the vehicle 14 acts as a miniature gyroscope. The gyroscopic forces thus created can act to lift the front of the vehicle 14 up off the track 10. The guide rod 25 in cooperation with the lip 30 prevents this occurrence. Tilting the vehicle 14 toward the post 34 as described above further aids the pivoting action and ensures smooth movement of the vehicle 14 as it negotiates the curve.

In the preferred embodiment, the lip 30 is shaped to form a substantially semicircular path for the vehicle 14, and the post 34 is located at approximately the geometric center of the semicircle. Further, the radius of the semicircle is less than the length of the vehicle 14. For example, the distance from the post 34 to the lip 30 over the curved portion of the track is approximately six centimeters, while the overall length of the vehicle 14 is about eight centimeters. The width of the vehicle 14 is about four centimeters.

While the invention is disclosed and a particular embodiment is described in detail, it is not intended that the invention be limited solely to this embodiment. Many modifications will occur to those skilled in the art which are within the spirit and scope of the invention. It is thus intended that the invention be limited in scope only by the appended claims.

What is claimed is:

1. A curved track for use with a self-propelled toy vehicle having wheels and a body, comprising in combination:

a surface portion over which the toy vehicle travels, said surface portion being formed so that said toy vehicle traveling around said track is tilted;

a wall portion upstanding from said surface portion and having a curved inner surface in the form of a semi-circle which defines the curved portion of the track;

a post portion upstanding from said surface portion and positioned at the geometric center of the semicircle whereby as said vehicle enters the curved portion of the track, the forward part of a first side of said vehicle body contacts said curved inner surface, and a rear part on a second side of said vehicle body, opposite the first side, contacts said post portion, causing said vehicle to pivot about said post portion in a direction which assists said vehicle in negotiating said curved portion of said track;

a lip integral with and projecting inwardly from said wall portion at a predetermined distance above said surface portion to form a recess around the inner periphery of said track; and a bumper, including a brush bar and a guide rod connected to and extending across the front of said toy vehicle, said brush bar contacting and sliding along said lip and said guide rod being positioned beneath said lip as said vehicle travels around said track to prevent the wheels of said vehicle from climbing up from said track.

2. The track of claim 1 in which the surface portion includes a curved step which forms a recess surface therein to aid in the tilting of said vehicle toward said post portion as said vehicle travels around said track.

3. The track of claim 2 further wherein said brush bar is formed from a resilient material to assist the sliding action against said lip to assist said vehicle to negotiate said curve.

4. The track of claim 3 wherein the radius of said circle is less than the length of said vehicle, and said curved track forms a 180 degree turn.

* * * * *